US010132141B2

(12) United States Patent
Caccialupi et al.

(10) Patent No.: US 10,132,141 B2
(45) Date of Patent: Nov. 20, 2018

(54) METAL PATCH SYSTEM

(71) Applicant: Mohawk Energy Ltd., Houston, TX (US)

(72) Inventors: Alessandro Caccialupi, Houston, TX (US); Matthew Allen, Houston, TX (US); Scott Benzie, Houston, TX (US)

(73) Assignee: Mohawk Energy Ltd., Houston, TX (US)

( * ) Notice: Subject to any disclaimer, the term of this patent is extended or adjusted under 35 U.S.C. 154(b) by 355 days.

(21) Appl. No.: 14/774,523

(22) PCT Filed: Mar. 12, 2014

(86) PCT No.: PCT/US2014/024696
§ 371 (c)(1),
(2) Date: Sep. 10, 2015

(87) PCT Pub. No.: WO2014/150978
PCT Pub. Date: Sep. 25, 2014

(65) Prior Publication Data

US 2016/0032696 A1 Feb. 4, 2016

Related U.S. Application Data

(60) Provisional application No. 61/791,451, filed on Mar. 15, 2013.

(51) Int. Cl.
*E21B 43/10* (2006.01)
*E21B 29/10* (2006.01)

(52) U.S. Cl.
CPC ..... *E21B 43/108* (2013.01); *E21B 29/10* (2013.01); *E21B 43/105* (2013.01); *E21B 43/103* (2013.01); *E21B 43/106* (2013.01)

(58) Field of Classification Search
CPC .. F16L 55/165–55/1658; F16L 2101/10; F16L 2101/18; F16L 2101/70;
(Continued)

(56) References Cited

U.S. PATENT DOCUMENTS 3,203,451 A * 8/1965 Vincent ..... B29D 22/00 138/143
6,142,230 A 11/2000 Smalley et al.
(Continued)

OTHER PUBLICATIONS

ISRWO for PCT Application PCT/US14/24696 dated Sep. 25, 2014.
UK Office Action for Application No. GB1516334.8 dated Sep. 30, 2015.

*Primary Examiner* — George S Gray
(74) *Attorney, Agent, or Firm* — Tumey L.L.P.

(57) ABSTRACT

An apparatus, method, and system for repairing wellbore casing. In one embodiment, an expandable casing patch system for a wellbore includes a casing patch deployment apparatus. The casing patch deployment apparatus includes a shaft having a frontward end and a rearward end as well as a thruster and a main expansion swage disposed on the shaft. The casing patch deployment apparatus also includes an anchor disposed on the shaft. The anchor is disposed frontward of the main expansion swage. In addition, the casing patch deployment apparatus includes a front expansion swage disposed frontward of the anchor and attached to the shaft. The front expansion swage has a diameter less than a diameter of the main expansion swage. The expandable casing patch system also includes an expandable casing patch.

20 Claims, 3 Drawing Sheets

(58) Field of Classification Search
CPC .... E21B 43/103; E21B 43/105; E21B 43/106; E21B 43/108; E21B 29/10; E21B 19/22; E21B 17/02; E21B 17/08; E21B 47/091; E21B 23/00; E21B 23/01; E21B 23/04
USPC ..... 166/384, 206, 207, 277
See application file for complete search history.

(56) References Cited

U.S. PATENT DOCUMENTS

| | | | | |
|---|---|---|---|---|
| 7,493,946 | B2 | 2/2009 | Filippov et al. | |
| 2003/0183397 | A1 | 10/2003 | Hoffman | |
| 2007/0034408 | A1* | 2/2007 | Benzie | E21B 7/208 175/57 |
| 2007/0240878 | A1* | 10/2007 | Filippov | E21B 23/01 166/207 |
| 2007/0272405 | A1 | 11/2007 | Gazewood | |
| 2009/0229835 | A1* | 9/2009 | Filippov | E21B 43/105 166/380 |
| 2010/0270035 | A1* | 10/2010 | Ring | E21B 29/10 166/384 |
| 2012/0097391 | A1 | 4/2012 | Whiddon | |
| 2012/0193088 | A1 | 8/2012 | Benzie et al. | |
| 2012/0227957 | A1* | 9/2012 | Xu | E21B 33/1208 166/118 |
| 2013/0206426 | A1* | 8/2013 | Whiddon | E21B 29/10 166/383 |

* cited by examiner

METAL PATCH SYSTEM

BACKGROUND OF THE INVENTION

Field of the Invention

This invention relates to the field of wellbores and more specifically to the field of casing patches for wellbore casings.

Background of the Invention

Procedures related to the construction and repair of wellbore tubular strings to facilitate hydrocarbon production or down-hole fluid injection are of increasing need. When an opening is formed in the sidewalls of an existing wellbore casing, whether through damage or intentional perforation, procedures typically include isolating an opening to conduct further operations. Such isolation may include installation of a casing patch over the damaged interval. However, in many cases, the existing wellbore casing may have geometrical constraints such as nipples positioned above the damaged area, and conventional casing patches may not be able to be installed without significant loss in pass-through internal diameter, which may limit well production or limit further operations.

Therefore, there is a need for improved casing patch systems for repairing openings in existing wellbore casings.

BRIEF SUMMARY OF SOME OF THE PREFERRED EMBODIMENTS

These and other needs in the art are addressed in one embodiment by an expandable casing patch for deployment in a wellbore. The wellbore comprises a restriction, and the restriction comprises a diameter. The wellbore also comprises wellbore casing. The expandable casing patch includes a base tubing and an under-gaged sealing component. The under-gaged sealing component comprises an internal diameter less than an internal diameter of the base tubing. An external diameter of the under-gaged sealing component is less than the diameter of the restriction. Upon radial expansion of the under-gaged sealing component, the under-gaged sealing component develops an interference contact with the wellbore casing.

These and other needs in the art addressed in another embodiment by an expandable casing patch system for a wellbore. The wellbore comprises a wellbore casing. The expandable casing patch system includes a casing patch deployment apparatus having a shaft with a frontward end and a rearward end. The casing patch deployment apparatus also includes a thruster and a main expansion swage disposed on the shaft. In addition, the casing patch deployment apparatus includes an anchor disposed on the shaft. The anchor is disposed frontward of the main expansion swage. A front expansion swage is disposed frontward of the anchor and attached to the shaft. The front expansion swage has a diameter less than a diameter of the main expansion swage. The expandable casing patch system also includes an expandable casing patch comprising an internal wall. The thruster provides force for propelling the main expansion swage through and radially expanding the expandable casing patch. The anchor is engageable to the internal wall to provide reaction force to propagate the main expansion swage through the expandable casing patch.

In addition, these and other needs in the art are addressed by an embodiment of a method for installation of an expandable casing patch in a wellbore. The wellbore also comprises a restriction, and the restriction comprises a diameter. The wellbore comprises a wellbore casing having a damaged interval. The method includes deploying an expandable casing patch and a casing patch deployment apparatus into the wellbore. The expandable casing patch comprises an expandable base tubing and at least two sealing components. The casing patch deployment apparatus includes a shaft having a frontward end and a rearward end. The casing patch deployment apparatus also include a thruster and a main expansion swage disposed on the shaft. In addition, the casing patch deployment apparatus includes an anchor disposed on the shaft, wherein the anchor is disposed frontward of the main expansion swage. Moreover, the casing patch deployment apparatus includes a front expansion swage disposed frontward of the anchor and attached to the shaft. The front expansion swage has a diameter less than a diameter of the main expansion swage. The method also includes positioning one sealing component on one side of the damaged interval and the other sealing component on an opposing side of the damaged interval. In addition, the method includes applying pressure and expanding the one sealing component providing sealing and anchoring to the wellbore casing. The method further includes expanding the expandable base tubing until the front expansion swage reaches the next sealing component. Moreover, the method includes applying a pull or push force to the casing patch deployment apparatus. The method also includes applying pressure and expanding the next sealing component by the main expansion swage providing sealing and anchoring to the wellbore casing. The method also includes repeating such steps until substantially all of the expandable casing patch is expanded.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other embodiments for carrying out the same purposes of the present invention. It should also be realized by those skilled in the art that such equivalent embodiments do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
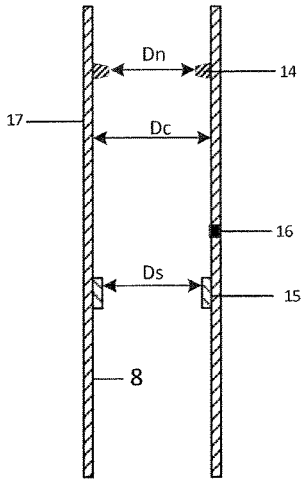
FIG. 1 illustrates an embodiment of a wellbore casing comprising geometrical restrictions with path-through diameters smaller than the internal diameter of the casing.
Figure 2:
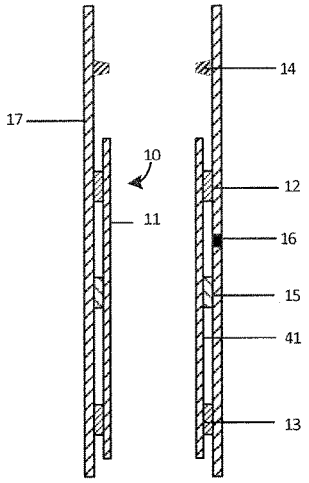
FIG. 2 illustrates an embodiment of a casing patch with hydraulic seals installed above and below damaged areas.

FIG. 1 shows schematically an existing wellbore casing 17 comprising a restriction 14 such as a nipple with a pass-through diameter (i.e., restriction minimum diameter Dn), which is smaller than the internal diameter of the existing casing Dc. Wellbore casing 17 also may include other restrictions such as damaged sleeve 15 with internal diameter (i.e., damaged sleeve minimum diameter Ds), which is smaller than the internal diameter of the existing casing Dc. Wellbore casing 17 may also include other damaged portions such as leaking connections or corroded areas 16. Embodiments include hydraulically isolating damaged areas (i.e., damaged sleeve 15 and/or corroded area 16) by providing a casing patch 10 with hydraulic seals 12 and 13 above and below the damaged areas (i.e., damaged sleeve 15 and/or corroded area 16), as shown in FIG. 2. Due to the diametrical restrictions described above, the deployment of the casing patch 10 includes that the outside diameters of casing patch 10 in an initial unexpanded state be less than the diameters of the restrictions Dn and Ds and upon expansion, the hydraulic seals 12 and 13 provide seals with the internal surface 8 of the existing wellbore casing 17, with the diameter Dc being greater than the diameters of any restrictions 14 or 15.

Figure 3:
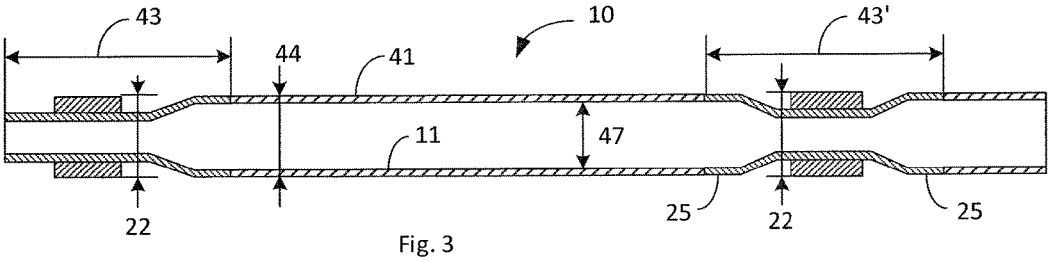
FIG. 3 illustrates an embodiment of a casing patch in a pre-expansion (run-in) form.

FIG. 3 illustrates an embodiment of an expandable casing patch 10 in a pre-expansion (run-in) form. Expandable casing patch 10 comprises a base tubing 41 and under-gaged sealing components 43, 43'. As shown in FIGS. 1-3, the outside diameters 22 of under-gaged sealing components 43, 43' and base tubing outside diameter 44 are less than the minimum diameter of the casing restrictions (i.e., restriction minimum diameter Dn of restriction 14 and/or damaged sleeve minimum diameter Ds of damaged sleeve 15).

Figure 4:
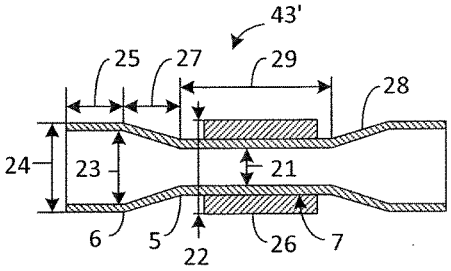
FIG. 4 illustrates an embodiment of an under-gaged sealing component in pre-expansion state.

FIG. 4 illustrates an embodiment of an under-gaged sealing component 43 in pre-expansion state. Under-gaged sealing component 43 is an expandable tubular 28 comprising three different areas: narrow area 29 with a smaller internal diameter 21; an area 25 with a larger internal diameter 23, i.e. which is larger than smaller internal diameter 21; and a transition area 27 with a variable internal diameter increasing from smaller internal diameter 21 (e.g., at intersection 5 of narrow area 29 and transition area 27) to larger internal diameter 23 (e.g., at intersection 6 of transition area 27 and area 25).

As shown in FIGS. 3 and 4, embodiments of expandable casing patch 10 include an under-gaged sealing component 43 with one area 25 with a larger internal diameter 23. In some embodiments as shown in FIG. 3, embodiments of expandable casing patch 10 include an under-gaged sealing component 43 with two areas 25 with larger internal diameters 23, with each area 25 on opposing sides of narrow area 29. As shown in FIGS. 3 and 4, embodiments of expandable casing patch 10 include narrow area 29 having a sealing element. In embodiments, the sealing element includes sealing element 26, which may be any suitable sealing device or sealing method for providing a seal at narrow area 29. Without limitation, examples of suitable sealing elements 26 include an elastomeric seal, a protrusion, or any combinations thereof. It is to be understood that a protrusion refers to a protruding area from external surface 7. Examples of suitable sealing elements 26 are disclosed in U.S. Patent Application Publication No. 2012/0193088, which is incorporated by reference herein in its entirety. For instance, U.S. Patent Application Publication No. 2012/0193088 discloses a compliant expandable sealing tubular.

In an embodiment, the outside diameter 22 of the sealing element 26 is limited by the minimum diameter of the pass-through restrictions (i.e., restriction minimum diameter Dn and/or damaged sleeve minimum diameter Ds), while the smaller internal diameter 21 of the sealing element 26 is selected such that upon the radial expansion of the sealing element 26, the sealing element 26 comes into interference contact with the existing wellbore casing 17 internal surface 8 of internal diameter Dc, thereby providing a hydraulic seal. The under-gaged sealing component 43 may be expanded by any conventional method such as pressure or swage propelled by hydraulic pressure or by pull by a conduit or any other apparatus.

It is to be understood that in some embodiments an expandable casing patch 10 may have two under-gaged sealing components 43, 43' and may also include conventional sealing components (not shown) having internal diameters the same as internal diameter 47 of the base tubing 41. It is also to be understood that casing patch 10 may have more than two under-gaged sealing components 43. In other alternative embodiments, casing patch 10 has at least one under-gaged sealing component 43 and at least one conventional sealing component.

Figure 5:
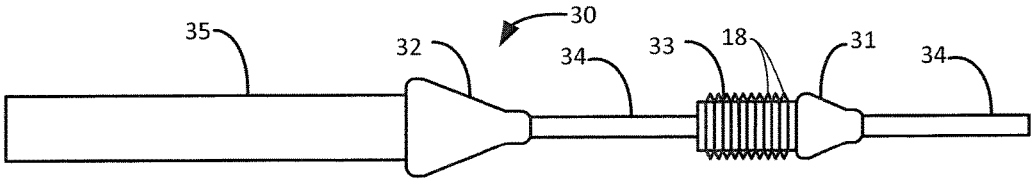
FIG. 5 illustrates an embodiment of a casing patch deployment apparatus for deployment and expansion of an expandable casing patch.
Figure 6A:
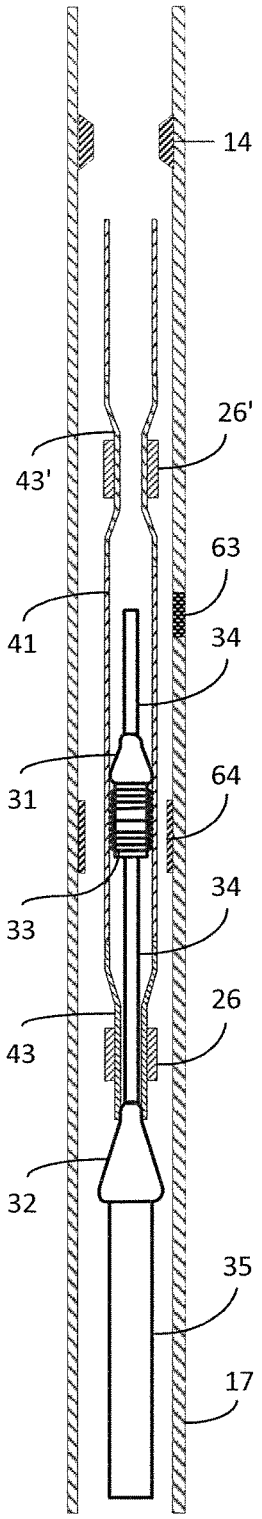
FIG. 6*a*) illustrates an embodiment of an operational sequence for deployment and installation of an expandable casing patch system.
Figure 6B:
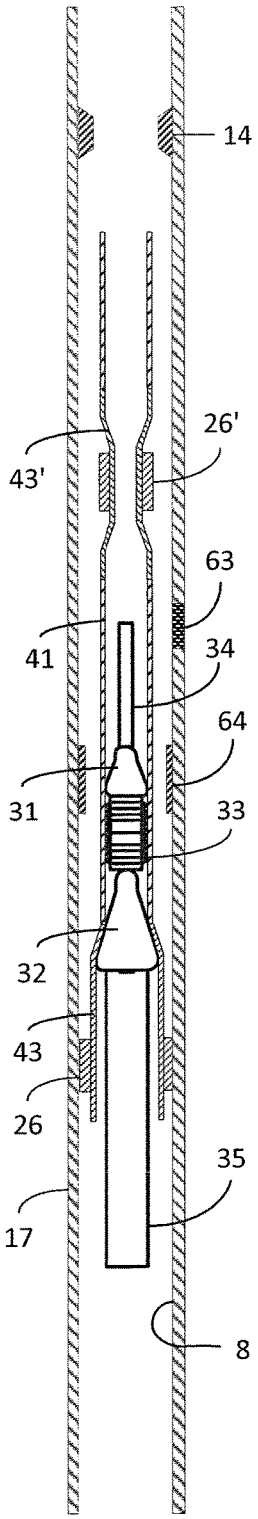
FIG. 6*b*) illustrates an embodiment of an operational sequence for deployment and installation of an expandable casing patch system.
Figure 6C:
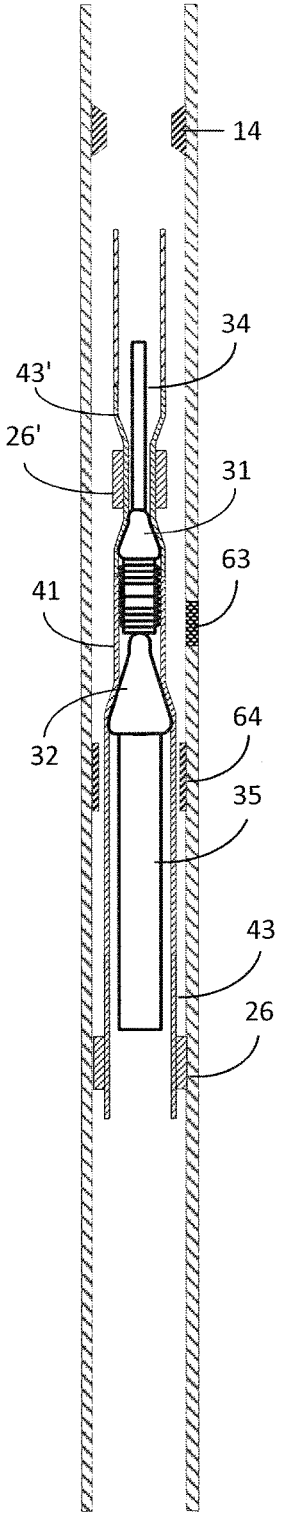
FIG. 6*c*) illustrates an embodiment of an operational sequence for deployment and installation of an expandable casing patch system.
Figure 6D:
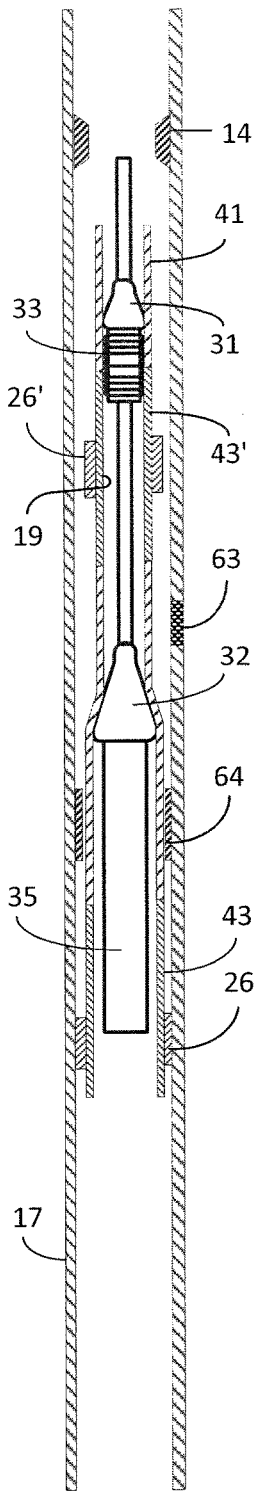
FIG. 6*d*) illustrates an embodiment of an operational sequence for deployment and installation of an expandable casing patch system.
Figure 6E:
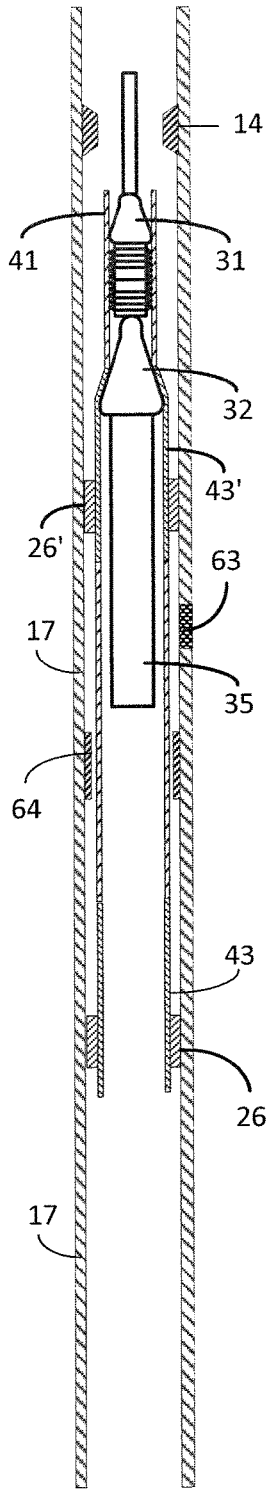
FIG. 6*e*) illustrates an embodiment of an operational sequence for deployment and installation of an expandable casing patch system.
Figure 6F:
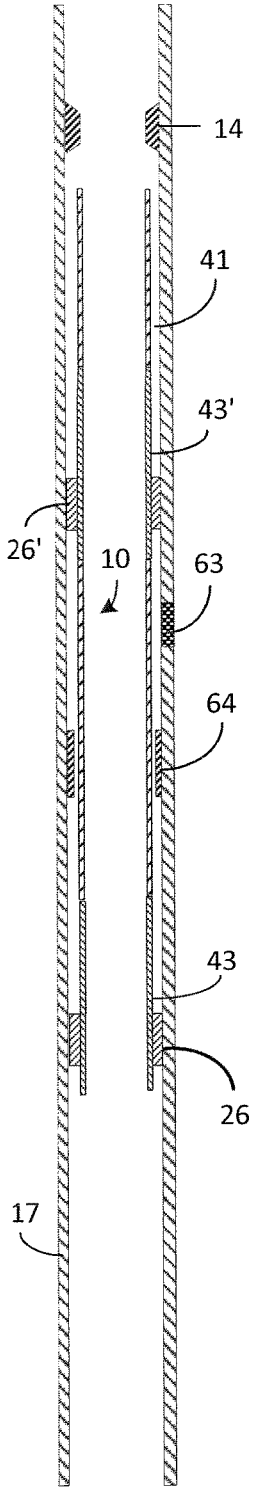
FIG. 6*f*) illustrates an embodiment of an operational sequence for deployment and installation of an expandable casing patch system.

FIG. 5 illustrates an embodiment of a casing patch deployment apparatus 30 for deployment and expansion of the expandable casing patch 10, as shown in FIG. 3. The casing patch deployment apparatus 30 comprises a hydraulic thruster 35, a main expansion swage 32 slidable over a shaft 34, an anchor 33, and a front expansion swage 31. The hydraulic thruster 35 may comprise any configuration suitable for propelling main expansion swage 32. For instance, embodiments include hydraulic thruster 35 comprising one or more pistons and one or more cylinders. In an embodiment as shown, hydraulic thruster 35 propels main expansion swage 32 through expandable casing patch 10 expanding its internal diameter substantially to the diameter of the main expansion swage 32. The shaft 34 comprises an internal opening (not illustrated) providing liquid communication to the hydraulic thruster 35. The anchor 33 is connected to the shaft 34. In embodiments, anchor 33 has a closed position and an open position. In embodiments, the anchor 33 in the closed position allows its longitudinal displacement inside the base tubing 41 with internal diameter 47. In further embodiments, the anchor 33 in the open position is engaged with the base tubing internal surface 11. In addition, embodiments include anchor 33 providing a sufficient reaction force for propagation of the main expansion swage 32 inside the expandable casing patch 10. Anchor 33 may include any anchor configuration suitable for allowing desired displacement. In embodiments, anchor 33 is a mechanical one-way anchor allowing displacement in the direction further from the main expansion swage 32 and providing resistance force in the opposite direction. In alternative embodiments, anchor 33 is hydraulically operated. In embodiments, the diameter of anchor 33 may be larger than the smaller internal diameter 21 of sealing element 26, and therefore the anchor 33 may be unable to pass through the sealing element 26, which may stall the expansion process by the main expansion swage 32. Alternatively, in embodiments in which anchor 33 is engaged in the area with a smaller internal diameter 21 only partially or in the transition area 27, the anchor 33 may damage under-gaged sealing component 43 and/or may cause damage to the anchor grips 18. Without limitation, for these reasons, the front expansion swage 31 is provided. In embodiments as shown, the front expansion swage 31 is connected to the shaft 34, and the diameter of front expansion swage 31 is about equal to the internal diameter 47 of the base tubing 41. Thus, the front expansion swage 31 being positioned in the front of the anchor 33 may expand the smaller internal diameter 21 of under-gaged sealing component 43 allowing the anchor 33 to pass through the under-gaged sealing component 43 and/or to provide sufficient anchoring force and thereby prevent damage to the under-gaged sealing component 43 or anchor grips 18.

In embodiments of operation of an expandable casing patch system comprising expandable casing patch 10 as shown in FIGS. 6(*a*)-6(*f*), casing patch 10 and casing patch deployment apparatus 30 are deployed in a wellbore on a conduit such as coiled tubing or a drill pipe (not shown) connected to the shaft 34 of the casing patch deployment apparatus 30. Casing patch 10 may be attached to the casing patch deployment apparatus 30 by any suitable device or method. Without limitation, examples of such device include a casing lock (not shown). In embodiments as shown, casing patch 10 is attached to the casing patch deployment apparatus 30 with the main expansion swage 32 being outside the first sealing component (e.g., under-gaged sealing component 43'), and the anchor 33 and front expansion swage 31 being inside the base tubing 41. The expandable casing patch 10 being in pre-expansion state is positioned with the under-gaged sealing component 43' being below the openings 63 and 64, and the second sealing component (e.g., under-gaged sealing component 43') being above the openings 63 and 64. Then, as shown in FIG. 6(*b*), pressure is applied that engages the anchor 33 and propels the main expansion swage 32 through the under-gaged sealing component 43' engaging the first sealing element (e.g., sealing element 26) in interference contact with the internal surface 8 of the existing wellbore casing 17 and providing sealing and anchoring of under-gaged sealing component 43 to the existing wellbore casing 17. In embodiments, the casing patch deployment apparatus 30 is then reset, i.e., the pressure is released, and the anchor 33 with the front expansion swage 31 is repositioned further in the base tubing 41 by mechanical pull via the conduit (not illustrated). Then, pressure is applied again engaging the anchor 33 and propelling the main expansion swage 32 through a portion of the base tubing 41, thereby expanding the base tubing 41. This process continues until the entire base tubing 41 is expanded. In alternative embodiments, base tubing 41 may be expanded by simply propagating the casing patch deployment apparatus 30 through the base tubing 41 by pulling casing patch deployment apparatus 30 via the conduit, since the base tubing 41 is anchored to the existing wellbore casing 17 by expanding the first sealing component (e.g., under-gaged sealing component 43). At a certain point, the front expansion swage 31 comes in contact with the second sealing component (e.g., under-gaged sealing component 43'), as shown in FIG. 6(*c*), then the pull force is applied, which results in the expansion of under-gaged sealing component 43' by the front expansion swage 31, as shown in FIG. 6(*d*), providing expanded inside diameter 19 of the sealing element 26' about equal to the unexpanded internal diameter 47 of the base tubing 41. This allows the anchor 33 to pass through the under-gaged sealing component 43' and/or properly be engaged with the expandable base tubing 41. The application of pressure engages the anchor 33 and propagates the main expansion swage 32 through the under-gaged sealing component 43' thereby engaging sealing element 26' with the wellbore casing 17, as shown in FIG. 6(*e*). Then, by applying a pull force via the conduit, the main expansion swage 32 expands the remainder of the expandable base tubing 41 (i.e., an exit joint), and the casing patch deployment apparatus 30 may be retrieved from the well. As a result, the casing patch 10 is installed in the existing wellbore casing 17 with the seals (e.g., sealing elements 26, 26') above and below the openings 63 and 64 and hydraulically isolating the openings 63 and 64, as shown in FIG. 6(*f*).

It is to be understood that embodiments of casing patch deployment apparatus 30 may include a second anchor for example such as described in U.S. Pat. No. 7,493,946, which is herein incorporated by reference in its entirety. In other embodiments, the expansion of the expandable casing patch 10 may be accomplished in top-down manner, resetting the casing patch deployment apparatus 30 by slacking-off the weight of the conduit.

Although the present invention and its advantages have been described in detail, it should be understood that various changes, substitutions and alterations may be made herein without departing from the spirit and scope of the invention as defined by the appended claims.

What is claimed is:

1. An expandable casing patch for deployment in a wellbore, wherein the wellbore comprises a wellbore casing, and wherein the wellbore casing comprises a restriction, and further wherein the restriction comprises a diameter less than an internal diameter of the wellbore casing, comprising:

a base tubing having a proximal end and a distal end, wherein a proximal expansion swage is initially positioned inside the base tubing;

a first recessed sealing component positioned distally to the proximal expansion swage, wherein the first recessed sealing component comprises an internal diameter less than an internal diameter of the base tubing; and a second recessed sealing component, wherein the proximal expansion swage is initially axially spaced between the first and second recessed sealing components;

wherein an external diameter of the first recessed sealing component is less than the diameter of the restriction; and wherein upon radial expansion of the first recessed sealing component, the first recessed sealing component develops an interference contact with the wellbore casing.

2. The expandable casing patch of claim 1, further comprising at least three sealing components.

3. The expandable casing patch of claim 1, wherein at least a portion of the base tubing is disposed between the sealing components.

4. The expandable casing patch of claim 1, wherein the base tubing is an expandable tubing.

5. An expandable casing patch system for a wellbore, wherein the wellbore comprises a wellbore casing, comprising:

a casing patch deployment apparatus, comprising:

a shaft having a proximal end and a distal end;

a thruster and a main expansion swage disposed on the shaft;

an anchor disposed on the shaft, wherein the anchor is disposed proximally to the main expansion swage; and a proximal expansion swage disposed proximally to the anchor and attached to the shaft, and wherein the proximal expansion swage has a diameter less than a diameter of the main expansion swage, and further wherein the proximal expansion swage is initially positioned inside an internal wall and proximally to a sealing component; and an expandable casing patch comprising the internal wall, wherein the thruster provides force for propelling the main expansion swage through and radially expanding the expandable casing patch, and wherein the anchor is engageable to the internal wall to provide reaction force to propagate the main expansion swage through the expandable casing patch.

6. The expandable casing patch system of claim 5, wherein the expandable casing patch comprises an expandable base tubing and a recessed sealing component.

7. The expandable casing patch system of claim 6, wherein the recessed sealing component comprises an internal diameter less than an internal diameter of the base tubing.

8. The expandable casing patch system of claim 6, wherein the wellbore casing comprises a restriction, and wherein the restriction comprises a diameter less than an internal diameter of the wellbore casing, and further wherein an external diameter of the recessed sealing component is less than the diameter of the restriction.

9. The expandable casing patch system of claim 6, wherein upon radial expansion of the recessed sealing component, the recessed sealing component develops an interference contact with the wellbore casing.

10. The expandable casing patch system of claim 6, wherein the expandable casing patch is attached to the casing patch deployment apparatus with the recessed sealing component disposed proximally to the main expansion swage.

11. A method for installation of an expandable casing patch in a wellbore, wherein the wellbore comprises a wellbore casing comprising a damaged interval and a restriction, and further wherein the restriction comprises a diameter less than an internal diameter of the wellbore casing, comprising:

(A) deploying an expandable casing patch and a casing patch deployment apparatus into the wellbore;

wherein the expandable casing patch comprises an expandable base tubing, and at least two sealing components;

wherein the casing patch deployment apparatus, comprises:

a shaft having a proximal end and a distal end;

a thruster and a main expansion swage disposed on the shaft, wherein the main expansion swage is disposed proximally to the thruster;

an anchor disposed on the shaft, wherein the anchor is disposed proximally to the main expansion swage; and a proximal expansion swage disposed proximally to the anchor and attached to the shaft, and wherein the proximal expansion swage has a diameter less than a diameter of the main expansion swage, and further wherein the proximal expansion swage is initially positioned inside the base tubing and initially axially spaced between the at least two sealing components;

(B) positioning a first proximal sealing component on a proximal side of the damaged interval and a second distal sealing component on an opposing distal side of the damaged interval;

(C) applying pressure to the anchor and expanding the second distal sealing component providing sealing and anchoring to the wellbore casing;

(D) expanding the expandable base tubing until the proximal expansion swage reaches the first proximal sealing component;

(E) applying a pull or push force to the casing patch deployment apparatus;

(F) applying pressure to the anchor and expanding the first proximal sealing component by the main expansion swage providing sealing and anchoring to the wellbore casing; and (G) repeating the expanding step, the applying a pull or push force step, and the second applying pressure to the anchor step until substantially all the expandable casing patch is expanded.

12. The method of claim 11, further comprising step (H) retrieving the casing patch deployment apparatus from the wellbore.

13. The method of claim 11, wherein the expandable casing patch comprises more than two sealing components and at least a portion of the expandable base tubing is disposed between the sealing components.

14. The method of claim 11, wherein at least one sealing component comprises a recessed sealing component.

15. The method of claim 14, wherein the recessed sealing component comprises an internal diameter less than an internal diameter of the expandable base tubing.

16. The method of claim 14, wherein an external diameter of the recessed sealing component is less than the diameter of the restriction.

17. The method of claim 11, wherein upon radial expansion the at least two sealing components develop interference contacts with the wellbore casing.

18. The method of claim 11, wherein the expandable casing patch is attached to the casing patch deployment apparatus with the first proximal sealing component disposed proximally to the main expansion swage.

19. The method of claim 11, wherein the expandable casing patch comprises an internal wall, wherein the thruster provides force for propelling the main expansion swage through and radially expanding the expandable casing patch.

20. The method of claim 19, wherein the anchor is engageable to the internal wall of the expandable casing patch to provide reaction force to propagate the main expansion swage through the expandable casing patch.

* * * * *